US006273313B1

(12) United States Patent
Noll et al.

(10) Patent No.: US 6,273,313 B1
(45) Date of Patent: Aug. 14, 2001

(54) PROCESS AND APPARATUS FOR CONTROLLING THE REGISTRATION OF CONVERTING OPERATIONS WITH PRINTS ON A WEB

(75) Inventors: Joseph Clifford Noll; Stephen Thomas Kohls, both of Cincinnati, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 0 days.

(21) Appl. No.: 09/324,133

(22) Filed: Jun. 2, 1999

(51) Int. Cl.[7] ..... B65H 23/18; B23Q 15/00

(52) U.S. Cl. ..... 226/30; 226/44; 493/11; 493/23

(58) Field of Search ..... 493/11, 23, 10; 226/30, 44, 493

(56) References Cited

U.S. PATENT DOCUMENTS

| | | | | |
|---|---|---|---|---|
| 3,667,664 | * | 6/1972 | Schroeder | 226/30 |
| 3,949,949 | * | 4/1976 | Thompson | 226/30 X |
| 4,147,078 | * | 4/1979 | Bishop | 226/30 X |
| 4,361,260 | * | 11/1982 | Hanlan | 226/30 |
| 4,459,885 | * | 7/1984 | Friberg | 83/74 |
| 4,715,846 | * | 12/1987 | Zak | 493/10 |
| 4,757,930 | | 7/1988 | Ditto . | |
| 4,781,317 | * | 11/1988 | Ditto | 226/27 |
| 4,896,605 | | 1/1990 | Schroeder | 101/486 |
| 4,955,265 | * | 9/1990 | Nakagawa et al. | 83/74 |
| 5,016,182 | * | 5/1991 | Bergland et al. | 226/44 X |
| 5,224,640 | | 7/1993 | Fokos et al. | 226/27 |
| 5,235,515 | * | 8/1993 | Ungpiyakul et al. | 364/469.04 |
| 5,452,632 | * | 9/1995 | Durr et al. | 83/13 |
| 5,455,764 | * | 10/1995 | Meihofer | 364/161 |
| 5,795,280 | * | 8/1998 | Fowler et al. | 493/22 |
| 5,802,974 | | 9/1998 | McNeil . | |
| 5,833,107 | * | 11/1998 | Terranova et al. | 226/31 |
| 5,839,688 | * | 11/1998 | Hertel et al. | 242/523.1 |
| 5,915,612 | * | 6/1999 | Hinton | 226/30 |
| 5,930,139 | * | 7/1999 | Chapdelaine et al. | 364/468.25 |
| 6,059,705 | * | 5/2000 | Ruthenberg et al. | 493/11 |
| 6,086,522 | * | 7/2000 | Hechler | 493/23 |
| 6,106,448 | * | 8/2000 | Obara et al. . | |

FOREIGN PATENT DOCUMENTS

500467 * 8/1992 (EP) .

* cited by examiner

*Primary Examiner*—Donald P. Walsh
*Assistant Examiner*—Minh-Chau Pham
(74) *Attorney, Agent, or Firm*—Vladimir Vitenberg; Jay A. Krebs

(57) ABSTRACT

A process and apparatus for maintaining the registration of folds with successive indicia on an advancing paper web is provided. The apparatus includes a control system for detecting the location of the indicia relative to a folding operation and adjusting the web speed to accommodate any mis-registration between the folds and the indicia.

19 Claims, 4 Drawing Sheets

PROCESS AND APPARATUS FOR CONTROLLING THE REGISTRATION OF CONVERTING OPERATIONS WITH PRINTS ON A WEB

FIELD OF THE INVENTION

The present invention relates to registration of indicia into a predetermined space on a paper web. Particularly, the present invention relates to controlling the location of the indicia during paper converting operations such as folding and cutting operations.

BACKGROUND OF THE INVENTION

Sheets for household use are well known in the art. It is often desired to decorate such sheets, such as by printing. Printing imparts an aesthetically pleasing pattern to the sheet. Alternatively, the sheet may be embossed to impart an aesthetically pleasing pattern which is also tactually discernible.

Such sheets are typically made in continuous form, then later cut to discrete lengths as desired. Such cutting to discrete lengths may occur at the point of use, such as is caused by the consumer detaching one sheet from the balance thereof at a line of termination. For this purpose, the line of termination typically comprises a line of weakness, such as a perforation. Alternatively, the continuous sheet may be folded and cut into discrete portions prior to the point of use. Such an arrangement often occurs in individual napkins which are folded and cut during manufacture and purchased by the consumer as discrete units.

It has been relatively facile in the prior art to register indicia with the cross machine direction of such sheets while such sheets are transported in a continuous fashion during a converting operation. However, it is more difficult to register the indicia in the machine direction, and particularly difficult to register the indicia with lines of termination, perforations, or folds produced by the converting machinery.

A phasing device is necessary to ensure that a machine direction misalignment of the web caused by web slippage or stretching will not cause each of the indicia occurring after the slippage or stretching to be placed out of registry with the converting machinery. Significant misregistry between the web indicia and converting machinery results in scrap of succeeding portions of the web affected by the misregistry. Therefore, an accurate web phasing device is essential for any commercial high speed converting operation requiring indicia to be registered in the machine direction relative to the operation being performed.

To control phasing of the web indicia with a particular converting operation it is necessary to monitor the degree of registry of the indicia with the converting operation in order to make the necessary adjustments in the converting operation machinery. Such monitoring device is generally performed by a photoelectric scanning device, generally referred to in the industry as a photo eye unit which senses registration marks on the web associated with each indicia and generates an indicia reference signal. In an ideal situation, the photo eye unit would be positioned within the operating station and would sense a registration mark at exactly the time that the associated converting operation were being performed on the web. A reference signal generated by the converting operation would be input to a signal comparator along with the web indicia signal to determine the degree of misregistry between the web and the equipment performing the converting operation. The system would then compensate for the misregistry by adjusting the orientation of the converting equipment. However, it is often times physically impossible to locate a photo eye unit in proximity to the converting equipment capable of detecting a registration mark located on the same region of the web in which the operation is being performed.

The placement of the photo eye away from the converting operation performed on the web is addressed in U.S. Pat. No. 5,802,974 issued to McNeil Sep. 8, 1998 the disclosure of which is incorporated herein by reference. McNeil addresses registering decorative indicia printed on a web moving in the machine direction with web perforations aligned in the cross machine direction. A photo eye detects misregistration via a signal comparator and adjust either the printing operation or the perforating operation while the web speed remains constant.

Varying the speed of an in-line operation such as perforating or printing can be accomplished where the web speed is maintained by a set of nip rollers or a winding operation which pulls the web past the operation being performed. During folding operations, folding cylinders are typically the last operation in the process such that adjusting the rotation of the folding cylinders to maintain print registration requires concurrent adjustment in the web speed. Although the design may be feasible, the maintenance of such a complex system may render it impractical, particularly for high speed applications.

For the present invention, a sensor for detecting misregistration of the indicia is placed a set distance upstream of the folding operation with a set of nip rolls interposed therebetween for controlling the speed of the web. A web speed control varies the rotational speed of the nip rolls increasing or decreasing the web speed to synchronize the registration of the indicia with fold lines produced by folding cylinders.

SUMMARY OF THE INVENTION

The present invention provides a process for registering indicia with folds on a web. The process comprises providing a web having a series indicia successively spaced in a machine direction. As the web advances in the machine direction, the indicia are in juxtaposition to a photo sensor which detects the position of the registration marks relative to the rotation of a pair of folding cylinders. The pair of folding cylinders are spaced a predetermined distance in the machine direction from the photo sensor. The photo sensor is linked to a web speed control which adjust the rate of web movement in the machine direction in order to synchronize the location of registration marks relative to the folds produced by the folding cylinders.

The web speed control comprises a signal comparator which receives first and second input signals. The first input signal is generated by the photo sensor detecting the position of the registration marks on the web. The second input signal is generated by a position resolver measuring the angular position of the folding cylinders. The signal comparator generates an error signal representing the misregistration of the indicia relative to the fold lines. The web speed is advanced or retarded via the nip rolls in order to continually reduce the error signal to zero.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

As used herein, the following terms have the following meanings:

"X-Y" directions define the plane of the paper web.

"Machine direction", designated MD, is the direction parallel to the flow of the paper web through the converting equipment.

"Cross machine direction", designated CD, is the direction perpendicular to the machine direction in the X-Y plane.

"Downstream" is the direction of flow of the web in the MD.

"Upstream" is the direction opposite the flow of the web in the MD.

"Embossing" refers to the process of deflecting a relatively small portion of a cellulosic fibrous structure normal to its plane and impacting the projected portion of the fibrous structure against a relatively hard surface to permanently disrupt the fiber to fiber bonds.

"Nip rolls" are a pair of rolls forming a loading plane connecting the centers of two parallel axes.

"Repeating" means the pattern is formed more than once.

An "indicium" is a distinctive marking, exhibiting a decorative aspect.

A "registration mark" is a reference point identifying the location of one indicium with respect to another.

"Design length" is the distance from the origin of one indicium of a repeating pattern to the origin of a subsequent indicium.

"Web speed" is the speed at which the web advances through converting equipment.

"Register" is a condition of being in correct alignment or in proper relative position.

Figure 1A:
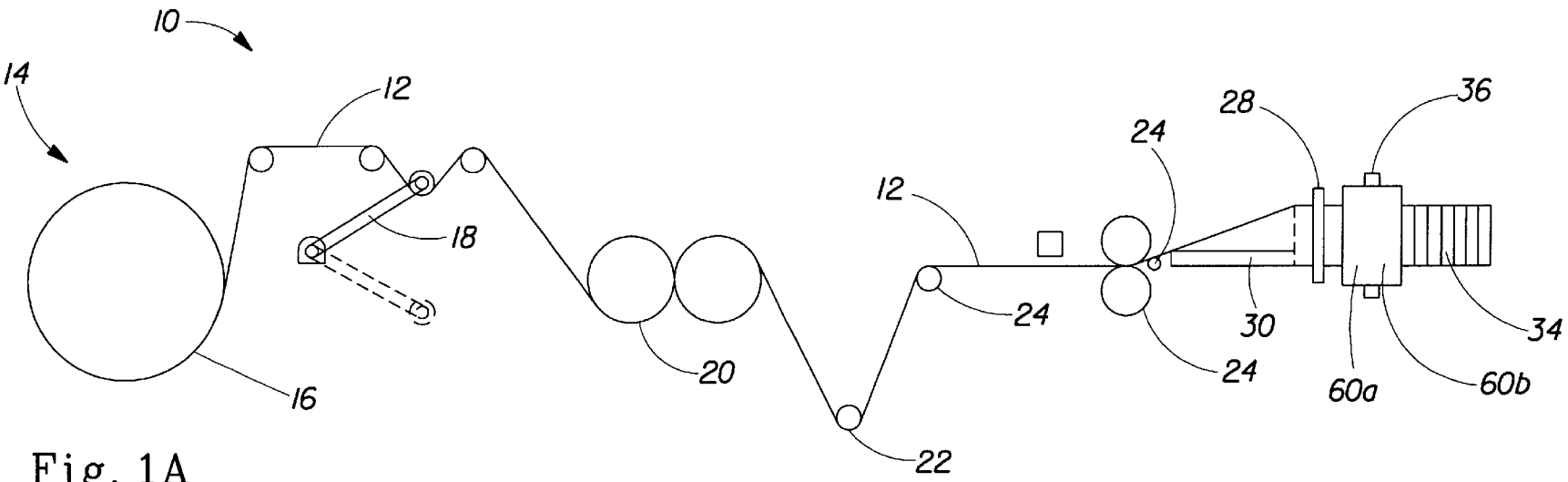
FIG. 1*a* is a schematic side elevational view of converting equipment used in producing folded sheets.
Figure 1B:
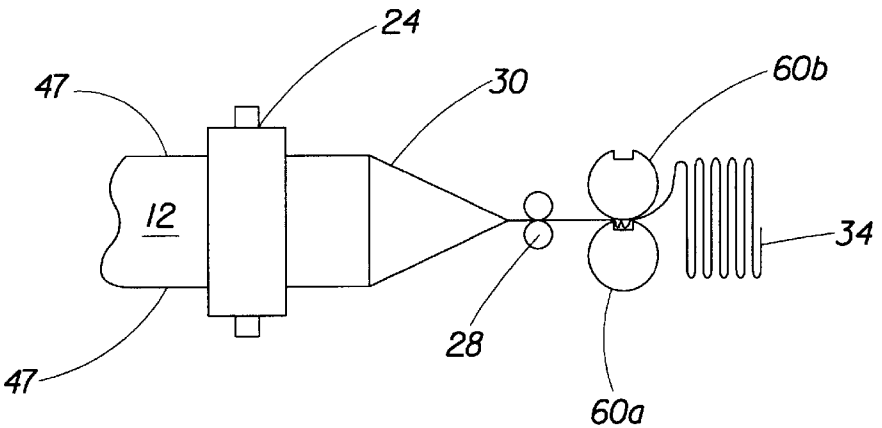
FIG. 1*b* is a top view of the folding equipment shown in FIG. 1*a*.

Referring to FIGS. 1*a* and 1*b*, registering indicia 45 on an advancing web 12 with a particular converting operation performed on the web 12 is difficult to achieve particularly if the operation is performed at the end of the converting line such as a folding or a cutting operation. Adjusting operating machinery at the end of the line so that the indicia 45 are in register with the fold or cut typically requires a simultaneous adjustment in web speed which is difficult to maintain particularly for high speed operations. Thus, it is more desirable to provide a converting operation where the machinery juxtaposed with the end of the line operates at a constant speed and the web speed is adjusted to accommodate any misregistration.

The web 12 according to the present invention is generally planar, soft and absorbent. The web 12 is suitable for use in applications, such as toilet tissue, paper toweling, placemats, napkins, etc. The web 12 is cellulosic, and preferably paper.

The web 12 according to the present invention may be made according to commonly assigned U.S. Pat. No. 4,191,609 issued Mar. 4, 1980 to Trokhan; U.S. Pat. Nos. 4,637,859 issued Jan. 20, 1987 to Trokhan; and 5,245,025 issued Sep. 14, 1993 to Trokhan et al., the disclosures of which patents are incorporated herein by reference.

As illustrated by the foregoing patents, the web 12 is preferably manufactured in a continuous process, then later cut into discrete units according to how the final product will be distributed to the consumer. Discrete units include roll products (such as paper toweling and bath tissue) and individual sheets (such as table napkins). For the present invention, the sheet 40 is presented to the consumer as an individually folded unit produced by a folding operation. Although the present invention may be equally applicable to various types of web folding and web chop-off operations, the application described hereunder is a folding operation utilizing pair of folding cylinders.

Illustrated in FIGS. 1*a* and 1*b* is a converting operation 60 for folding and cutting a paper web 12 having indicia 45 disposed thereon. The indicia 45 may include registration marks. A feedback control system governs the location of the indicia 45 with respect to fold lines via variable speed nip rolls 28 which advance or retard the web speed while delivering the paper web 12 from a parent roll 16 to a folding table 30, and eventually a pair of folding cylinders 60*a* and 60*b*. The pair of folding cylinders 60*a*, 60*b* rotate at a constant angular velocity forming a continuous web stack 34 which is eventually cut in half producing two equal stacks of individually folded sheets 40.

The output produced by most converting operations is a function of the web speed. For the present invention web speed is set at a base speed by the surface speed of the folding cylinders 60*a*, 60*b* and advanced or retarded by the variable speed nip rolls 28. The web speed can be as low as about 1000 feet/minute, preferably the web speed can be as low as 500 feet/ minute, more preferably the web speed can be as low as about 100 feet/minute. The web speed can be as high as about 2000 feet/minute, preferably the web speed can be as high as about 2500 feet/minute, more preferably the web speed can be as high as about 3000 feet/minute.

Advancing or retarding the web speed in order to accommodate registration of the indicia 45 with the folding operation may require adjustments to other equipment upstream of the folding operation. For instance, during converting operations such as the folding process, the web 12 is drawn from an unwind stand 14 comprising a parent roll. The parent roll is typically surface driven by an unwind stand motor. In order to maintain the rate at which the folding operation calls for the web supply from the parent roll 16, a dancer 18 connected to a feedback position sensor for the unwind stand motor governs the speed at which the parent roll 16 is unwound.

The converting operation may include embossment rolls 20 between the unwind stand 14 and the folding equipment. The embossment rolls typically have an independent drive requiring a separate feedback control system for adjusting to the rapid changes in web speed induced by the variable speed nip rolls. Such feedback control system may include a load cell 22 which is an electronic device for measuring reaction forces at an idler bearing. The reaction forces can be used to measure the average tension in the web.

The indicia 45 may be applied to the web 12 by any means known in the art suitable for applying spaced indicia 45 at predetermined repeating intervals. The indicia 45 may be aesthetically pleasing and printed, either in a single color or in a plurality of colors. Alternatively, the indicia 45 may be embossed or applied in a manner affecting inherent properties of the web 12 such as caliper, strength, softness etc. The equipment applying the indicia may be installed upstream of the folding equipment. Such equipment typically have independent drives requiring separate feedback control systems for accommodating adjustments in web speed.

In a preferred embodiment, the indicia 45 are printed onto the web 12 from a rotatable cylinder. The rotatable cylinder is driven about a central axis at a predetermined angular velocity. Suitable printing processes known in the art include gravure printing and flexographic printing. A suitable apparatus for applying the indicia 45 to the substrate is disclosed in commonly assigned U.S. Pat. No. 5,213,037 issued May 25, 1993 to Leopardi, II, the disclosure of which patent is incorporated herein by reference.

If it is desired to emboss the indicia 45 onto the web 12, any embossing technique well known in the art is suitable. Suitable embossing techniques include those described in commonly assigned U.S. Pat. No. 3,414,459 issued Dec. 3, 1968 to Wells; U.S. Pat. No. 3,556,907 issued Jan. 19, 1971 to Nystrand; and U.S. Pat. No. 5,294,475 issued Mar. 15, 1994 to McNeil, the disclosures of which are incorporated herein by reference.

In an alternative embodiment, the indicia 45 may comprise known additives which increase the adhesion, softness, wet strength, temporary wet strength, hydrophobicity/hydrophilicity, or which functionally affects any other property of the web 12 may be applied thereto. A device which may be used in intermittent operation and suitable for applying functional indicia 45 to the web 12 is disclosed in commonly assigned U.S. Pat. No. 5,143,776 issued Sep. 1, 1992 to Givens, the disclosure of which is incorporated herein by reference.

Prior to folding, the web 12 is drawn along idler rollers by the variable speed nip rolls such that the longitudinal edges 47 of the web 12 are aligned with the MD. During the folding operation the web 12 is folded two times, first in the CD so that each of the longitudinal edges 47 is contiguous, producing a fold line running in the MD and second in the MD producing a fold line running in the CD. The folded web 12 is subsequently cut in half, parallel to the fold line running in the CD. The cutting operation divides the web 12 into individual folded sheets and forms the leading and trailing edges 46, 48 which are contiguous in the folded arrangement.

Figure 2:
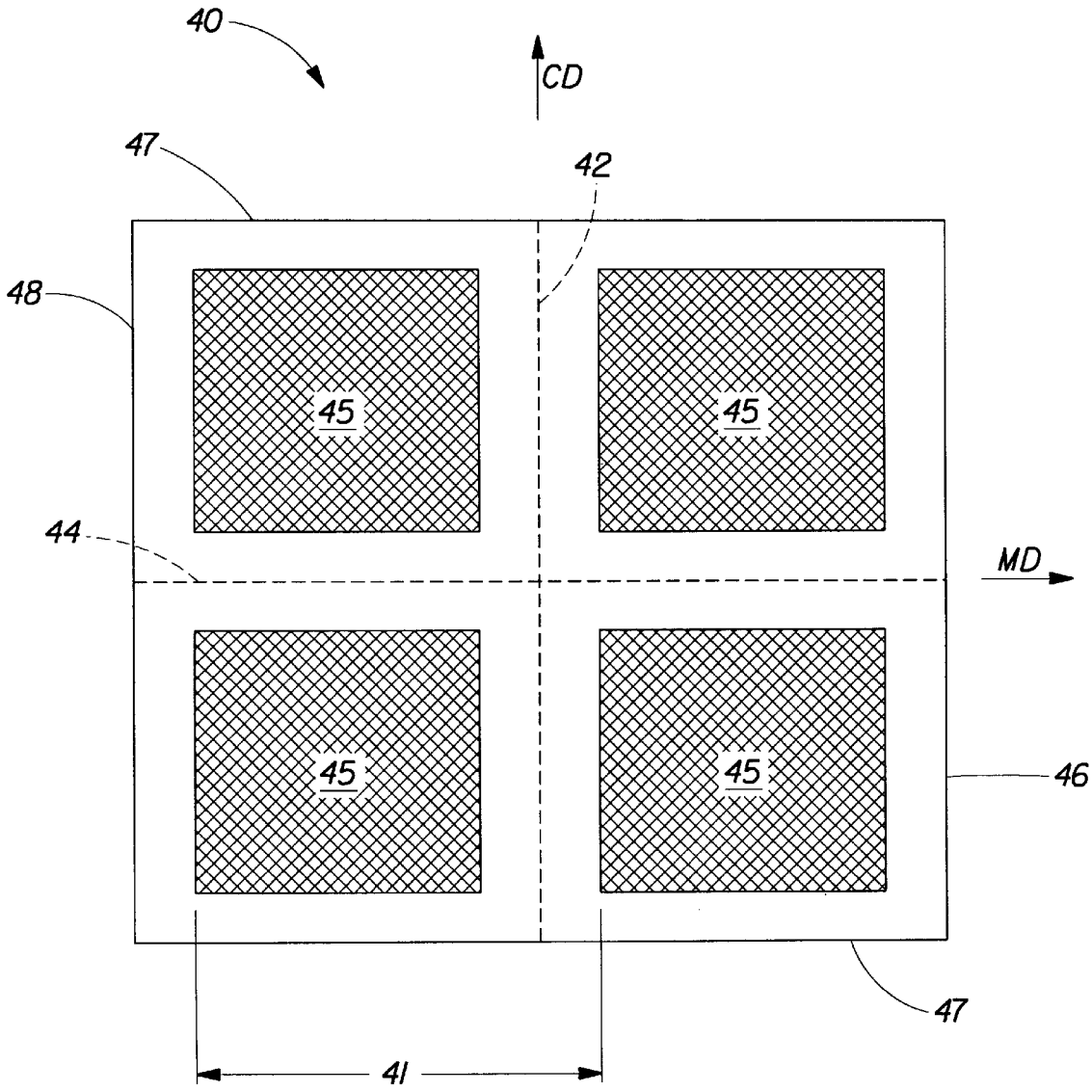
FIG. 2 is a top view of a typical single sheet produced by the converting operation illustrated in FIGS. 1*a* and 1*b*.

As shown in FIG. 2, each unfolded sheet comprises four quadrants defined by orthogonal fold lines running in the MD and the CD and the corresponding leading 46, trailing 48 and longitudinal edges 47. The indicia may be arranged in any repeating manner with respect to the quadrants. For the sheet illustrated in FIG. 2, the Indicia 45 are disposed within each quadrant, juxtaposed with the CD fold line 42 and the corresponding leading 46 or trailing edge 48 of the sheet 40 and generally oriented in the CD within the X-Y plane of the sheet.

The CD fold lines 42 are spaced from the indicia 45 a predetermined distance that is repeated in succession. For the sheet illustrated in FIG. 2, the CD fold lines 42 are centered between two successive indicia 45 such that the distance between successive CD fold lines 42 is about equal to the design length 41. This results in a spaced relationship that is repeated throughout the folding process. The spaced relationship is maintained by a control system that monitors the registration of the indicia 45 relative to the folding operation and adjust the web speed to correct misregistration occurring between the indicia 45 and the CD fold lines 42.

The folding operation may be accomplished by any suitable means for folding and cutting a continuous web 12 to form individual sheets having four quadrants defined by perpendicular fold lines. Referring to FIGS. 1*a* and 1*b*, as the web 12 travels in the MD it advances upon a folding board 30 which folds the web 12 in the CD bringing the longitudinal edges together in a face-to-face relationship producing MD fold lines. The folded web 12 is delivered to a pair of folding cylinders 60*a*, 60*b* which transversely fold the web 12 in the MD forming a continuous web stack 34 with CD fold lines 42 on opposite ends of the stack 34.

Figure 3:
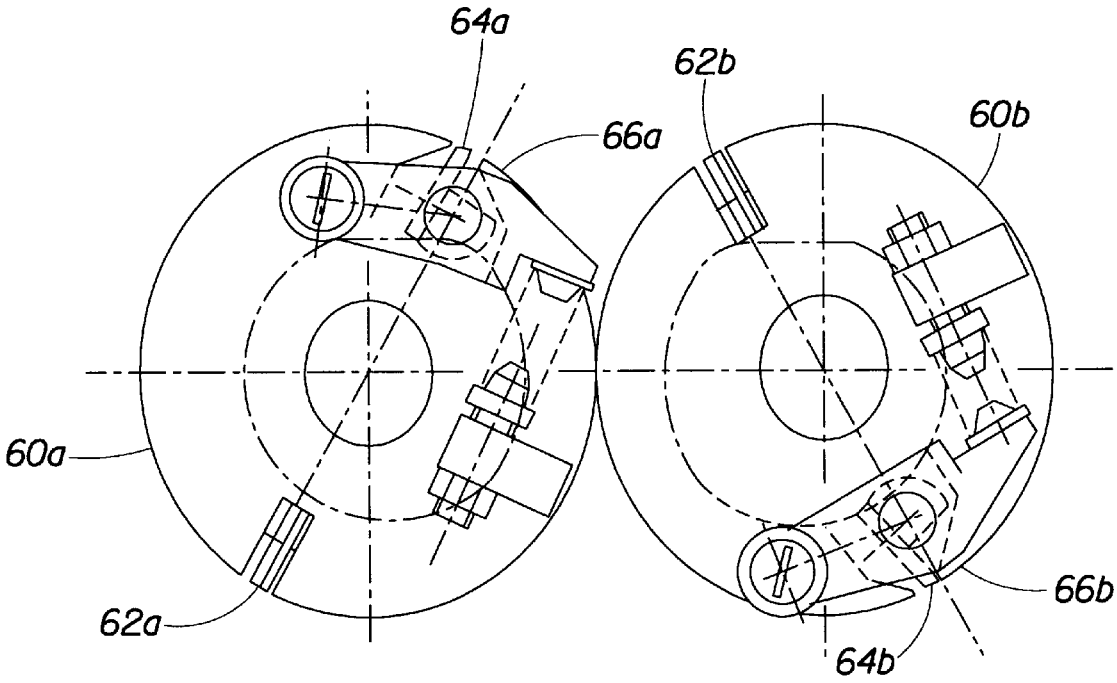
FIG. 3 is a schematic of the folding cylinders used in the converting operation illustrated in FIGS. 1*a* and 1*b*.
Figure 4:
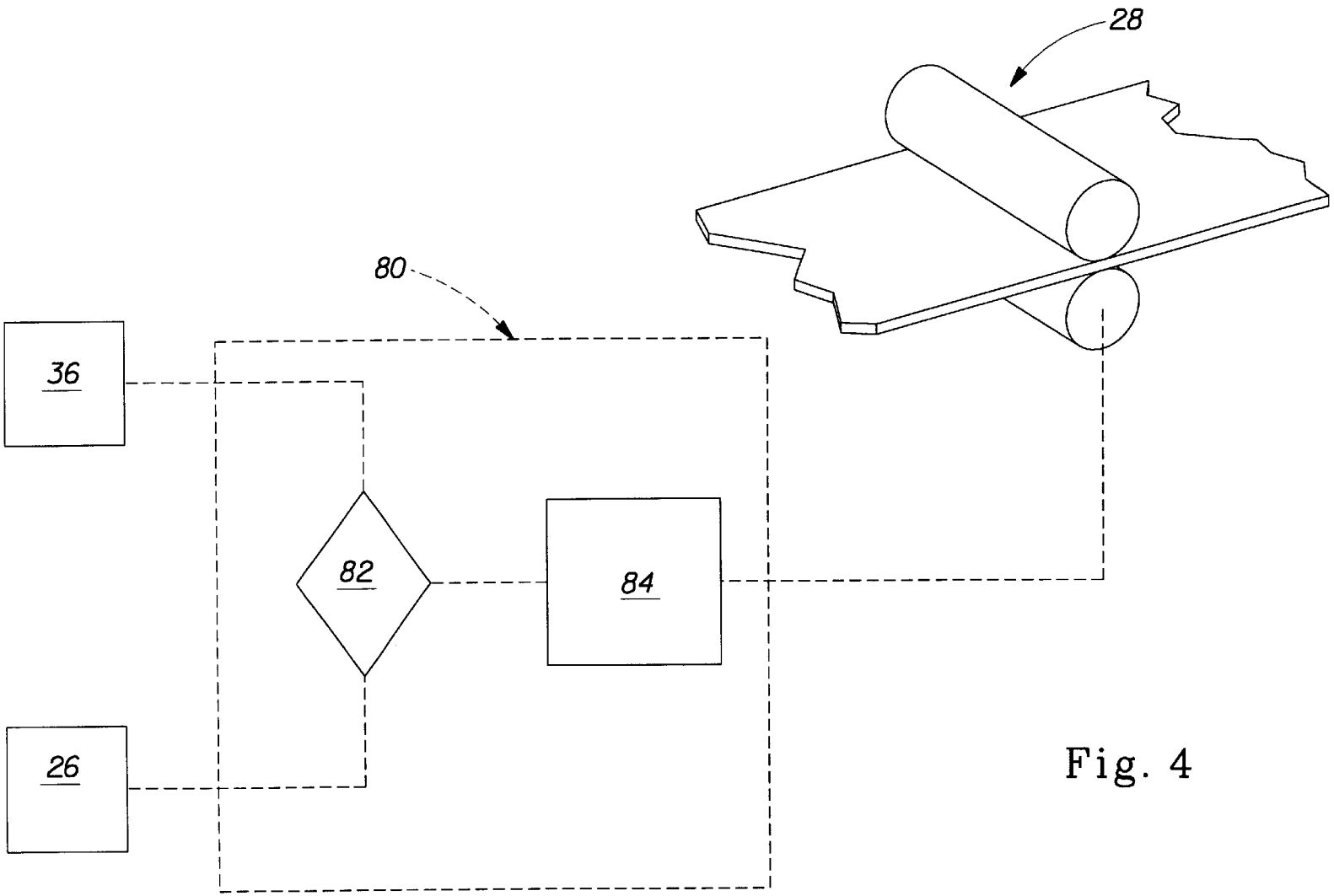
FIG. 4 is schematic of the control system used to maintain the print registration with the folds during folding operation depicted in FIGS. 1*a* and 1*b*.

A typical folding cylinder arrangement is depicted in FIG. 3. The arrangement includes a pair of opposing, continuously turning cylinders 60*a*, 60*b*. Each cylinder 60*a*, 60*b* includes a folding knife 62*a*, 62*b* and a folding jaw 64*a*, 64*b* that pivots towards an anvil 66*a*, 66*b*. During operation, the folding knife 62*a* of one folding cylinder 60*a*, enters between the folding jaw 64*b* and anvil 66*b* of the opposing folding cylinder 60*b*, pressing the web 12 into this intermediate space and guiding the web 12 up to the opening of the folding jaw 64*b*. Shortly before the completion of the closing movement of the folding jaw 64*b*, the folding knife 62*a* is guided out of this space and the web 12 is clamped between the folding jaw 64*b* and the anvil 66*b* and guided along the circumference of the continuously turning folding cylinder 60*b* until the folding jaw 64*b* opens and the folded web 12 is released. Concurrently, while the folding cylinder 60*b* releases the web 12, the folding knife 62*b* of the same cylinder 60*b* enters between the folding jaw 64*a* and anvil 64*a* of the opposing cylinder 60*a*, pressing the web 12 therein and the and the process is repeated. This repetitive process proceeds forming a continuous web stack 34.

In order to maintain the arrangement of the indicia 45 within the quadrants for successive sheets, a control system monitors the location of the indicia 45 relative to the placement of the CD fold lines 42. Prior to the folding process, the web 12 travels in the machine direction over a series of idler rollers 24 in juxtaposition to an optic sensor 26 fixed a known distance upstream of the folding cylinders 60*a*, 60*b*. The optic sensor 26 detects the position of the indicia 45 on the web 12. Preferably the sensor 26 determines the difference in reflectance between the indicia 45 and the web 12.

Of course, the indicia 45 may not provide adequate contrast with the web 12. In this case a registration mark may be applied to the web 12 in register with the indicia. The registration mark may be included within the indicia 45 or it may be applied to the trim of the web 12. Trim refers to that portion of the web 12 at the outboard edges, and which is later removed from the portion of the sheet 40 which is presented to the consumer. Since the trim is not presented to the consumer, registration marks applied to the trim may be of any size and shape suitable for indicating its position to the sensing means. Preferably the registration mark 31 is printed onto the web 12 by the same printing plate used to print the indicia 45. In this manner the spacing of the registration mark relative to the indicia 45, or any part thereof, is known.

The optic sensor 26 produces a first signal comprising real time pulses for every indicia 45 passing in juxtaposition to the sensor 26. The real time pulses represent the position of the indicia 45 with respect to time.

The folding cylinders 60*a*, 60*b* are set at a constant angular velocity which establishes the base web speed. A position resolver 36 mounted on the folding cylinders 60*a*, 60*b* produces a second signal comprising a numerical value that repeats every rotation. The numerical values represent the angular position of the folding cylinders 60*a*, 60*b* at any point in time.

A suitable position resolver 38 is available from the Reliance Electric Co. of Cleveland, Ohio as Model No. M/N 57C360 and is typically designated by the motor which drives the rotatable component from which the signal is taken. The resolver may be used in conjunction with a resolver input module, such as is available from Reliance Electric as Part No. M/N 57C411. If desired, an encoder can be substituted for the position resolver 36, provided one uses the appropriate control logic, as is well known in the art. A suitable position resolver 36 is capable of determining angular position within at least 0.1 degrees. A preferred position resolver has at least 4,096 distinct positions corresponding to a numerical value per rotation.

The photo sensor 26 and the position resolver 36 are set up such that the real time pulses produced by the photo sensor are desired to coincide with a specific numerical value produced by the position resolver 36. The specific numerical value produced by the position resolver 36 indicates the angular position of the folding cylinders where the CD fold lines 42 are in register with the indicia. Misregistration between the indicia 45 (registration marks) and the CD fold lines 42 is measured and corrected via a web speed control 80. The web speed control 80 comprises a signal comparator 82 which activates a servo motor 84 coupled to the variable speed nip rolls 28. A suitable signal comparator 82 is a Reliance Electric Auto Max Processor Module comprising the resolver photo eyes and resolver input cards.

The first and second signals are input to the signal comparator 82 which measures the pulses created by the first signal and the numerical value produced by the second signal to yield an error signal. The error signal is based on the difference between the actual numerical value of the second signal and the specific numerical value desired for the indicia to register with the CD fold lines. The difference between the actual numerical value and the desired numerical value represents distance between the desired location on the web where the CD fold line is in register with the indicia and the actual location of the CD fold line on the web.

The error signal may be compared to a preset value to determine whether an adjustment in web speed is required. The preset value is the distance between the actual CD fold line location relative to the indicia and the desired CD fold line location relative to the indicia. In other words, the preset value represents the amount by which the CD fold lines are out of register with the indicia. Suitable preset values for the present invention are ±0.125 inches (for a total range of 0.25 inches) and preferably ±0.063 inches (for a total range of 0.125 inches). Most preferably, the preset value for the present invention is equal to zero. Thus, when the signal comparator detects an error, the variable speed nip rolls 28 are activated via the servo motor 84 to advance or retard the web speed in order to continually reduce the error to zero.

Of course, it will be recognized by one skilled in the art that several sheets 40 according to the present invention may be made in parallel, by using multiple roll positions as is known in the art. In such a process, a single web having a width several times greater than the sheet 40 presented to the consumer is transported through the apparatus 10. As used herein, a "web" comprises a plurality of sheets integral with one another and simultaneously transported through the converting operation 10 in parallel in the cross-machine direction.

The web is later slit or cut, in the machine direction, into individual webs. Each web 12 proceeds through separate folding processes operating in parallel in a fashion similar to the process described above.

Of course, one of ordinary skill will recognize it may be desired to adjust the cross-machine direction registration of the web 12. Misregistration of the web 11 in the cross-machine direction causes skew in the aforementioned spaced relationship. One may compensate for such skew by adjusting the path length of the web 12, using means well known in the art. For example, bowed rolls, curved axis rolls having fixed and variable radii of curvature, cocking rolls, Mount Hope rolls, etc. may be used to change the path length of one portion of the web 12, or even an individual sheet, relative to the balance of the web 12 or sheet 40.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A process for registering indicia with folds on a web, the process comprising the steps of:

providing a web, the web having a series of detectable indicia successively spaced in a machine direction;

providing a pair of folding cylinders rotating at a constant angular velocity producing CD fold lines in the web, providing an optic sensor disposed at a sensor location and spaced a predetermined distance in the machine direction from the folding cylinders, the optic sensor being structured to detect the successively spaced indicia producing a first signal comprising real time pulses, providing a position resolver coupled to the folding cylinders and structured to track the angular position of the folding cylinders, thereby producing a second signal comprising a numerical value corresponding to the angular position of the folding cylinder;

providing a web speed control structured to receive the first signal and the second signal and to adjust the web speed so that the CD fold lines are successively spaced in register with the indicia;

advancing the web in the machine direction and in juxtaposition with the optic sensor so that the indicia detectably pass the optic sensor;

adjusting the web speed via the web speed control so that the CD fold lines are successively spaced in register with the indicia; and providing a web tension load cell upstream of the nip rolls to enable compensation for variations in web tension corresponding to adjustments in web speed.

2. The process according to claim 1 wherein the web speed control comprises a signal comparator which receives the first signal and the second signal and adjust the web speed via a servo motor coupled to variable speed nip rolls.

3. The process according to claim 2 wherein the signal comparator generates an error signal based on the real time pulses from the first signal and the numerical value from the second signal.

4. The process according to claim 3 wherein the error signal is the difference between a specific numerical value and an actual numerical value provided by the second signal for each real time pulse provided by the first signal.

5. The process according to claim 4 wherein the web speed control continually reduces the error signal to zero.

6. The process according to claim 1 wherein the folding cylinders are downstream of the optic sensor.

7. The process according to claim 1 further comprising the steps of providing a folding board upstream of the folding cylinders and advancing the web across the folding board to produce MD fold lines in the web.

8. The process according to claim 8 wherein the MD fold lines are orthogonal to the CD fold lines.

9. The process according to claim 1 wherein each folding cylinder includes a folding knife, a folding jaw, and an anvil wherein the folding jaw pivots toward the anvil.

10. The process according to claim 1 wherein the web speed ranges from about 100 feet/minute to about 3000 feet/minute.

11. The process according to claim 1 wherein the web speed ranges from about 500 feet/minute to about 2500 feet/minute.

12. The process according to claim 1 wherein the web speed ranges from about 1000 feet/minute to about 2000 feet/minute.

13. An apparatus for controlling the registration of CD fold lines with indicia successively spaced in the MD on an advancing web, the apparatus comprising:

a motor driven rotatable component for advancing the web;

a pair of folding cylinders producing CD fold lines successively spaced in the MD;

an optic sensor disposed at a sensor location a predetermined distance in the MD from the folding cylinders in juxtaposition to the web so that the successively spaced indicia detectably pass the optic sensor enabling the optic sensor to produce a first signal comprising real time pulses;

a position resolver coupled to the folding cylinders, the position resolver tracks the angular position of the folding cylinders producing a second signal comprising a numerical value; and a web speed control linked to the optic sensor and the position resolver, wherein the web speed control receives the first signal and the second signal and adjusts the web speed via the motor driven rotatable component so that the CD fold lines are in register with the indicia; and a web tension load cell disposed upstream of the nip rolls to enable compensation for variations in web tension corresponding to adjustments in web speed.

14. The apparatus according to claim 13 wherein the web speed control comprises a signal comparator and a servo motor coupled to the motor driven rotatable component.

15. The apparatus according to claim 14 wherein the signal comparator generates an error signal based on the real time pulses from the first signal and the numerical value from the second signal.

16. The apparatus according to claim 15 wherein the error signal is the difference between a specific numerical value and an actual numerical value provided by the second signal for each real time pulse provided by the first signal.

17. The apparatus according to claim 16 wherein the web speed control continually reduces the error signal to zero via the servo motor.

18. The apparatus according to claim 13 wherein the motor driven rotatable component comprises variable speed nip rolls.

19. The apparatus according to claim 13 further comprising a folding board disposed upstream of the folding cylinders for producing MD fold lines in the advancing web.

* * * * *